US010431134B2

(12) United States Patent
Kwak

(10) Patent No.: US 10,431,134 B2
(45) Date of Patent: Oct. 1, 2019

(54) DISPLAY DEVICE HAVING MASTER AND SLAVE DRIVERS AND ELECTRONIC DEVICE HAVING THE SAME

(71) Applicant: SAMSUNG DISPLAY CO., LTD., Yongin-si, Gyeonggi-do (KR)

(72) Inventor: Boo-Dong Kwak, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 56 days.

(21) Appl. No.: 15/141,888

(22) Filed: Apr. 29, 2016

(65) Prior Publication Data

US 2017/0084228 A1 Mar. 23, 2017

(30) Foreign Application Priority Data

Sep. 17, 2015 (KR) ..... 10-2015-0131822

(51) Int. Cl.
*G09G 3/20* (2006.01)

(52) U.S. Cl.
CPC ..... *G09G 3/20* (2013.01); *G09G 2310/0221* (2013.01); *G09G 2320/0626* (2013.01); *G09G 2320/0686* (2013.01); *G09G 2360/16* (2013.01)

(58) Field of Classification Search
CPC ... G09G 2310/0221; G09G 2320/0626; G09G 2320/0686; G09G 2360/16; G09G 3/20
See application file for complete search history.

(56) References Cited

U.S. PATENT DOCUMENTS 7,830,353 B2 * 11/2010 Chen ..... G09G 3/3611 345/100
8,593,493 B2 * 11/2013 Ohishi ..... G09G 3/342 345/102
2007/0182683 A1 * 8/2007 Chin ..... G09G 3/3688 345/88
2010/0302214 A1 * 12/2010 Kim ..... G09G 3/20 345/204
2014/0160176 A1 * 6/2014 Nose ..... G09G 3/3406 345/690

FOREIGN PATENT DOCUMENTS

KR 10-2010-0130086 A 12/2010

* cited by examiner

*Primary Examiner* — Ram A Mistry
(74) *Attorney, Agent, or Firm* — Lee & Morse, P.C.

(57) ABSTRACT

A display device includes a driver for a display panel. The display panel includes a first area and a second area that includes a plurality of pixels. The driver includes a master driver and a slave driver. The master driver compensates a first image signal for the first area to generate a first compensation signal based on the first image signal and a second image signal for the second area. A first data signal corresponding to the first compensation signal and a scan control signal a provided to the first area. The slave driver compensates the second image signal to generate a second compensation signal based on the first image signal and the second image signal. A second data signal corresponding to the second compensation signal and the scan control signal are provided to the second area.

18 Claims, 8 Drawing Sheets

DISPLAY DEVICE HAVING MASTER AND SLAVE DRIVERS AND ELECTRONIC DEVICE HAVING THE SAME

CROSS-REFERENCE TO RELATED APPLICATION

Korean Patent Application No. 10-2015-0131822, filed on Sep. 17, 2015, and entitled, "Display Device and Electronic Device Having the Same," is incorporated by reference herein in its entirety.

BACKGROUND

1. Field

One or more embodiments described herein relate to a display device and an electronic device having a display device.

2. Description of the Related Art

A variety of flat panel displays have been developed to replace cathode-ray tube displays. Examples include liquid crystal displays, field emission displays, plasma display panels, and organic light emitting displays (OLEDs). OLEDs have wide viewing angle and rapid response speed. These displays are also thin and have relatively low power consumption. However, current OLEDs have drawbacks.

SUMMARY

In accordance with one or more embodiments, a display device includes a display panel including a first area and a second area that include a plurality of pixels; and a driver including a master driver and a slave driver, the master driver to compensate a first image signal for the first area to generate a first compensation signal based on the first image signal and a second image signal for the second area, and to provide a first data signal corresponding to the first compensation signal and a scan control signal to the first area, the slave driver to compensate the second image signal to generate a second compensation signal based on the first image signal and the second image signal and to provide a second data signal corresponding to the second compensation signal and the scan control signal to the second area.

Each of the master driver and the slave driver may be implemented as a multi-chip that includes a timing controller and a data driver. The timing controller of the master driver may generate synchronization signals to control an output timing of the first compensation signal and the second compensation signal and may provide the synchronization signals to the timing controller of the slave driver.

The master driver may provide the first compensation signal to the data driver of the master driver based on the synchronization signals, and the slave driver is to provide the second compensation signal to the data driver of the slave driver based on the synchronization signals.

The timing controller of the master driver may generate a control signal to control the scan driver of the display panel, the control signal to be generated by changing a voltage level of the control signal, and to provide the control signal to the timing controller of the slave driver. The master driver may provide the scan control signal to a scan driver of the first area, and the slave driver may generate the scan control signal by changing a voltage level of the control signal and is to provide the scan control signal to a scan driver of the second area.

The timing controller of the master driver may generate a first compensation control signal to compensate the first image signal based on the first image signal and the second image signal and may compensate the first image signal into the first compensation signal based on the first compensation control signal. The timing controller of the slave driver may generate a second compensation control signal to compensate the second image signal based on the first image signal and the second image signal and may compensate the second image signal into the second compensation signal based on the second compensation control signal.

Each of the master driver and the slave driver may include a select terminal, and the master driver and the slave driver are to be operated as the master driver and the slaver driver based on a select signal provided to the select terminal. The driver may include at least one slave driver.

In accordance with one or more embodiments an electronic device includes a display device; and a processor to control the display device, wherein the display device includes: a display panel including a first area and a second area that include a plurality of pixels; and a driver including a master driver to compensate a first image signal corresponding to the first area to generate a first compensation signal based on the first image signal and a second image signal corresponding to the second area, to provide a first data signal corresponding to the first compensation signal and a scan control signal to the first area and a slave driver to compensate the second image signal to generate a second compensation signal based on the first image signal and the second image signal, and to provide a second data signal corresponding to the second compensation signal and the scan control signal to the second area. Each of the master driver and the slave driver may be implemented as a multi-chip that includes a timing controller and a data driver.

The timing controller of the master driver may generate synchronization signals to control an output timing of the first compensation signal and the second compensation signal and may provide the synchronization signals to the timing controller of the slave driver. The master driver may provide the first compensation signal to the data driver of the master driver based on the synchronization signals, and the slave driver may provide the second compensation signal to the data driver of the slave driver based on the synchronization signals.

The timing controller of the master driver may generate a control signal to control the scan driver of the display panel, the scan control signal to be generated by changing a voltage level of the control signal, and may provide the control signal to the timing controller of the slave driver. The master driver may provide the scan control signal to a scan driver of the first area, and the slave driver may generate the scan control signal by changing a voltage level of the control signal and is to provide the scan control signal to a scan driver of the second area.

The timing controller of the master driver may generate a first compensation control signal to compensate the first image signal based on the first image signal and the second image signal and may compensate the first image signal into the first compensation signal based on the first compensation control signal.

The timing controller of the slave driver may generate a second compensation control signal to compensate the second image signal based on the first image signal and the second image signal and to compensate the second image signal based on the second compensation control signal.

Each of the master driver and the slave driver may include a select terminal, and the master driver and the slave driver may be operated as the master driver and the slaver driver based on a select signal provided to the select terminal. The driver may include at least one slave driver.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
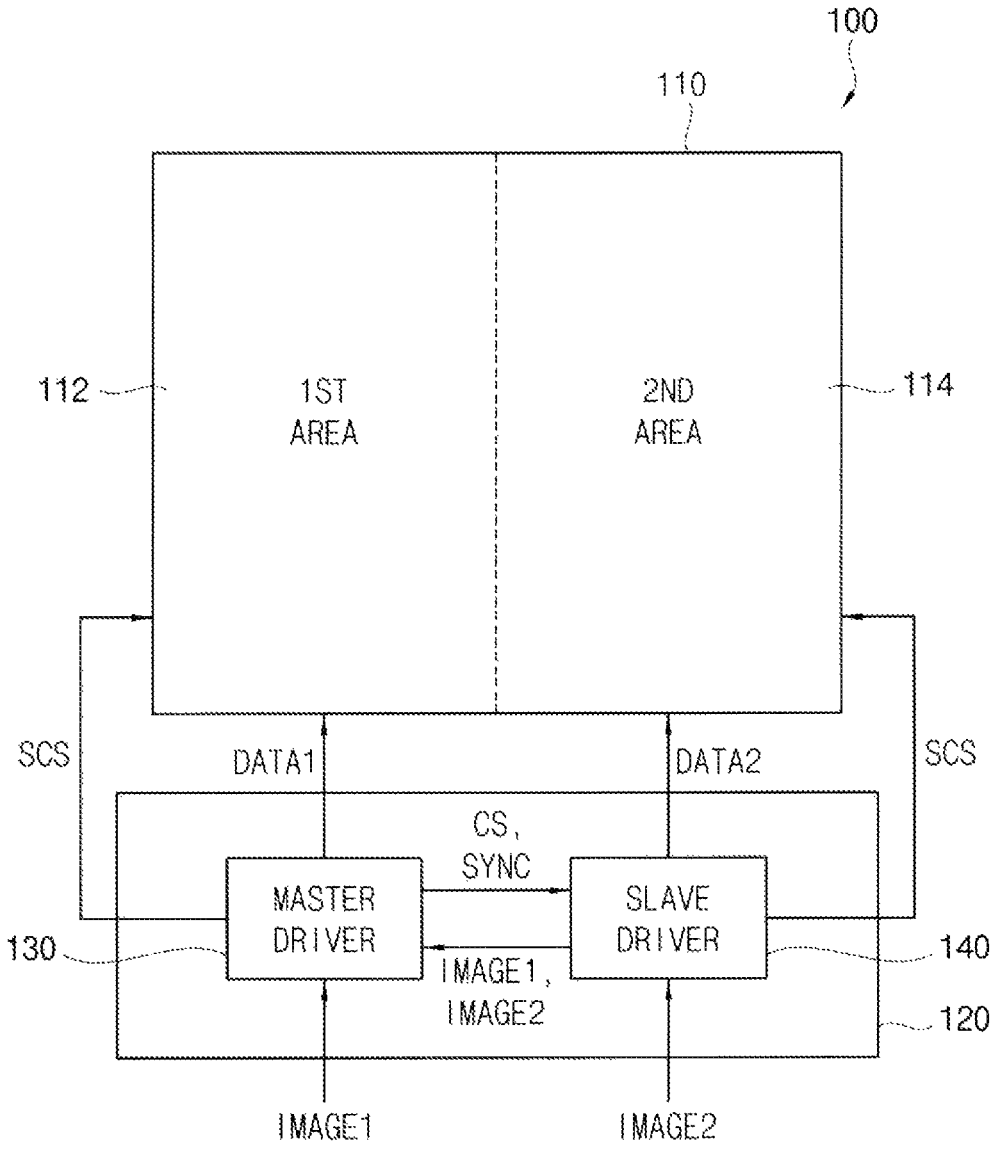
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
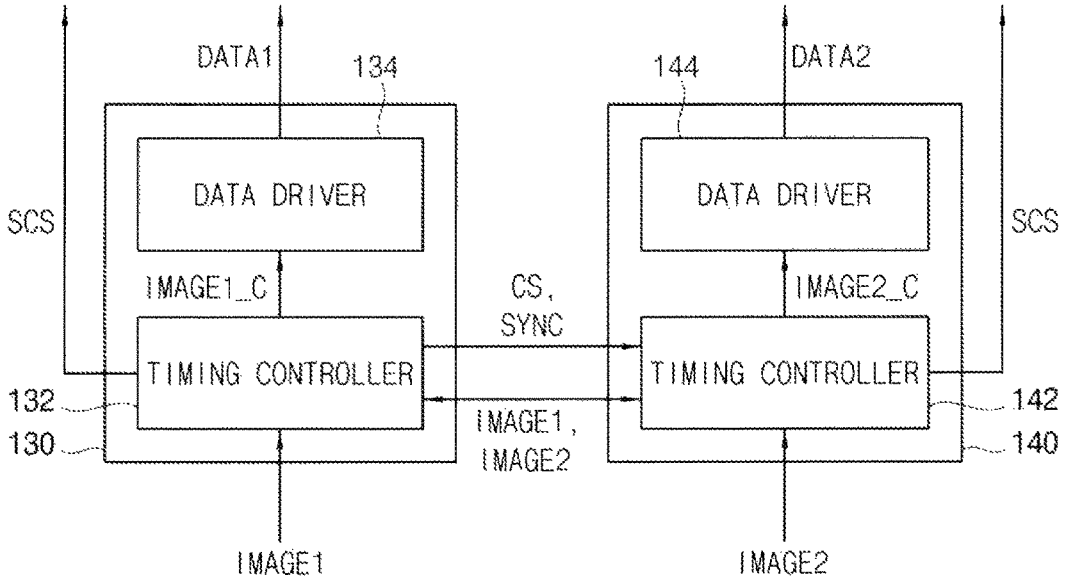
FIG. 2 illustrates an embodiment of a master driver and a slave driver.

FIG. 1 illustrates an embodiment of a display device 100, and FIG. 2 illustrating an embodiment of a master driver and a slave driver in the display device 100 of FIG. 1.

Referring to FIGS. 1 and 2, the display device 100 includes a display panel 110 and a driver 120. The display panel 110 may include a plurality of pixels and is divided into a plurality of areas, e.g., a first area 112 and a second area 114. In one embodiment, the display panel 110 may be divided into N areas corresponding to the number master driver and slave drivers.

The driver 120 may include a master driver 130 and a slave driver 140. The master driver 130 may compensate a first image signal IMAGE1 to generate a first compensation signal IMAGE1_C based on the first image signal IMAGE1 provided to the first area 112 and a second image signal IMAGE2 provided to the second area 114, and may provide a first data signal DATA1 corresponding to the first compensation signal IMAGE1_C and a scan control signal SCS to the first area 112. The master driver 130 may be implemented as a multi-chip that includes a timing controller 132 and a data driver 134, for example, as described in FIG. 2.

The timing controller 132 may generate a control signal CS to control a scan driver and a scan control signal SCS, for example, by changing the voltage level of the control signal CS. The scan driver that generates the scan signal based on the scan control signal SCS may be in one or more non-display areas of the display panel 110. The timing controller 132 may generate the scan control signal SCS for input into the scan driver 120 in the first area 112. The timing controller 132 may provide the control signal CS to the timing controller 142 of the slave driver 140.

The timing controller 132 may generate a first compensation control signal that compensates the first image signal IMAGE1 based on the first image signal IMAGE1 provided to the master driver 130 and the second image signal IMAGE2 provided to the slave driver 140. The timing controller 132 may compensate the first image signal IMAGE1 to generate the first compensation signal IMAGE1_C based on the first compensation control signal.

In one embodiment, the timing controller 132 may compensate the image signal based on a brightness of the image signal. For example, the master driver 130 may compensate the first image signal IMAGE1 using an auto current limit (ACL) method. A compensation value of the first image signal IMAGE1 and a compensation value of the second image signal IMAGE1 may be different from each other when the master driver 130 and the slave driver 140 are respectively operated. Thus, the image displayed on the first area 112 and the image displayed on the second area 114 may be different.

In order to prevent the difference between the image in the first area 112 and the image in the second area 114, the master driver 130 and the slave driver 140 may compensate each of the image signals IMAGE1, IMAGE2 based on the first image signal IMAGE1 and the second image signal IMAGE2. The master driver 130 and the slave driver 140 may provide and receive the first image signal IMAGE1 and the second image signal IMAGE2, for example, through a serial interface. The timing controller 132 may generate the first compensation control signal that compensates the first image signal IMAGE1 based on the first image signal IMAGE1 and the second image signal IMAGE2, and may compensate the first image signal IMAGE1 to generate the first compensation signal IMAGE1_C based on the first compensation control signal.

The timing controller 132 may generate synchronization signals SYNC that control an output timing of the first compensation signal IMAGE1_C. For example, the synchronization signals SYNC may include a clock signal, a horizontal synchronization signal (Hsync), and a vertical synchronization signal (Vsync). The timing controller 132 may provide the first compensation signal IMAGE1_C to the data driver 134 of the master driver 130 based on the synchronization signals SYNC. Further, the synchronization signals SYNC generated in the timing controller 132 may be provided to the timing controller 142 of the slave driver 140 to control an output timing of the second compensation signal IMAGE2_C.

The data driver 134 of the master driver 130 may convert the first compensation signal IMAGE1_C from the timing controller 132 of the master driver 130 to an analog voltage corresponding to a grayscale value. The analog voltage may be provided to the pixels in the first area 112 as a first data signal DATA1.

The timing controller 142 of the slave driver 140 may generate the scan control signal SCS by changing the voltage level of the control signal CS from the timing controller 132 and may provide the scan control signal SCS to the scan driver of the second area 114.

The timing controller 142 of the slave driver 140 may generate a second compensation control signal that compensates the second image signal IMAGE2 based on the first image signal IMAGE1 provided to the master driver 130 and the second image signal IMAGE2 provided to the slave driver 140. The timing controller 142 may compensate the second image signal IMAGE2 to generate the second compensation signal IMAGE2_C based on the second compensation control signal. The timing controller 142 of the slave driver 140 may compensate the image signal, for example, based on the brightness of the image signal. In one embodiment, the slave driver 140 may compensate the second image signal IMAGE2 using the automatic current limit (ACL) method.

The compensation value of the first image signal IMAGE1 and the compensation value of the second image signal IMAGE1 may be different from each other when the master driver 130 and the slave driver 140 are respectively operated. Thus, the image displayed on the first area 112 and the image displayed on the second area 114 may be different. In order to prevent the difference between the image displayed on the first area 112 and the image in the second area 114, the master driver 130 and the slave driver 140 may compensate each of the image signals IMAGE1, IMAGE2 based on the first image signal IMAGE1 and the second image signal IMAGE2. The master driver 130 and the slave driver 140 may provide and receive the first image signal IMAGE1 and the second image signal IMAGE2, for example, through the serial interface.

The timing controller 142 of the slave driver 140 may generate the second compensation control signal that compensates the second image signal IMAGE2 based on the first image signal IMAGE1 and the second image signal IMAGE2 and may compensate the second image signal IMAGE2 to generate the second compensation signal IMAGE2_C based on the second compensation control signal.

The timing controller 142 of the slave driver 140 may control the output timing of the second compensation signal IMAGE2_C based on the synchronization signals SYNC from the master driver. For example, the synchronization signals SYNC may include a clock signal, a horizontal synchronization signal (Hsync), and a vertical synchronization signal (Vsync).

The data driver 144 of the slave driver 140 may convert the second compensation signal IMAGE2_C from the timing controller 142 of the slave driver 140 to an analog voltage corresponding to a grayscale value. The analog voltage may be provided to the pixels in the first area 112 as a second data signal DATA2.

The display device 100 may synchronize the master driver 130 and the slave driver 140 by providing the control signal CS and the synchronization signals SYNC generated in the master driver 130 to the slave driver 140. Further, the display device 100 may prevent the difference between the image displayed on the first area 112 and the image displayed on the second area 114 by generating the first compensation signal IMAGE1_C in the master driver 130 and the second compensation signal IMAGE2_C in the slave driver 140 based on the first image signal IMAGE1 and the second image signal IMAGE2. The driver 120 in FIGS. 1 and 2 has one master driver 130 and one slave driver 140. In another embodiment, the driver 120 may have a plurality of slave drivers and one or more master drivers 130.

Figure 3:
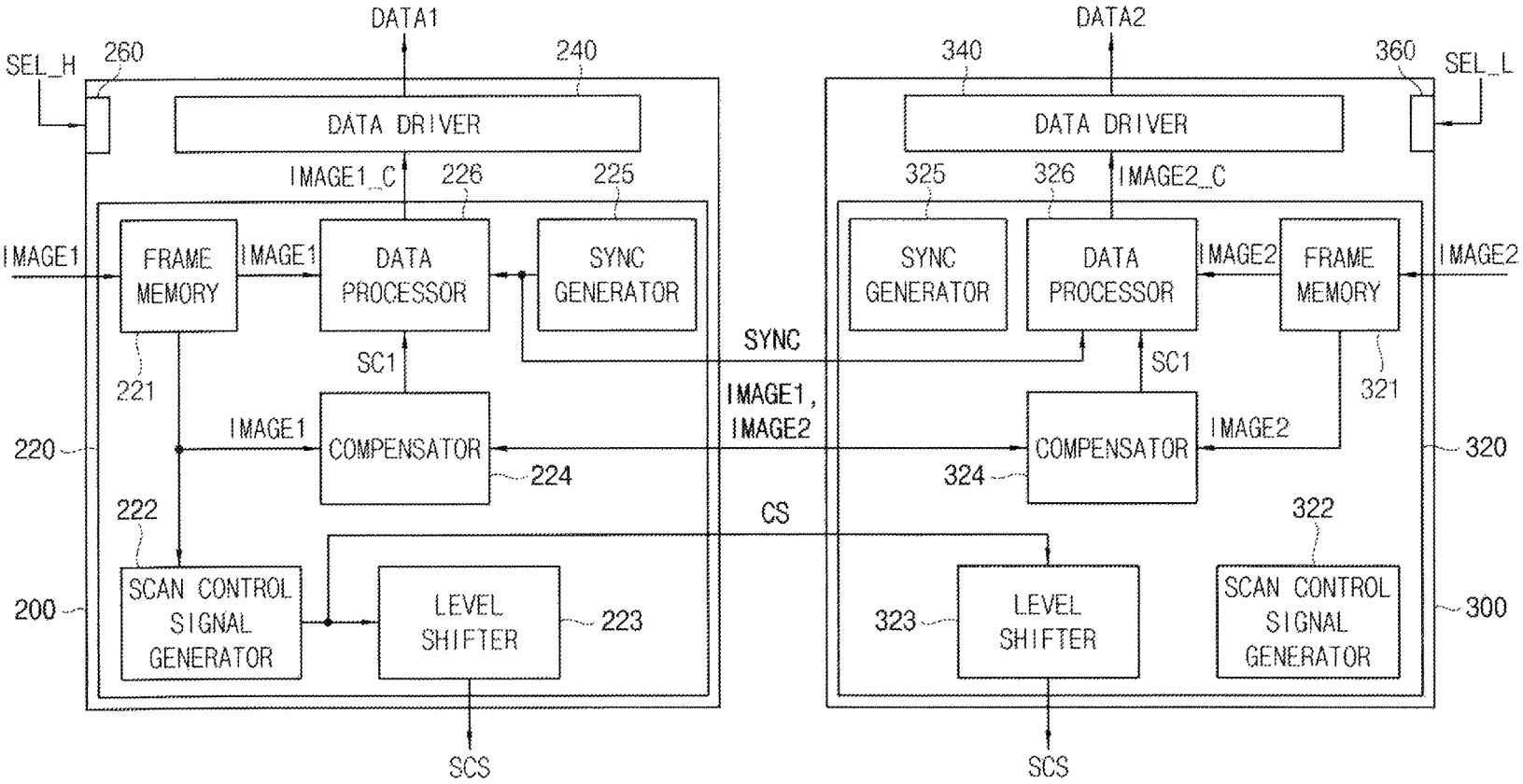
FIG. 3 illustrates an example of operations of the master driver and slave driver.

FIG. 3 illustrates an embodiment which includes a master driver 200 and a slave driver 300, which, for example, may be included the display device 100 of FIG. 1. Referring to FIG. 3, a master driver 200 and a slave driver 300 may be implemented as integrated circuits that have the same structure. The integrated circuit may have a select terminal that receives a select signal.

The integrated circuit may be operated as the master driver 200 or the slave driver 300 based on the select signal provided to the select terminal. For example, the integrated circuit may be operated as the master driver 200 when the select signal SEL_H having a high level is provided to the select terminal 260. The integrated circuit may be operated as the slave driver 300 when the select signal SEL_L having a low level is provided to the select terminal 360.

The master driver 200 may include a timing controller 220 and a data driver 240. The timing controller 220 may include a frame memory 221, a scan control signal generator 222, a level shifter 223, a compensator 224, a synchronization signal generator 225, and a data processor 226. The frame memory 221 may store a first image signal IMAGE1 provided to the master driver 200 per frame. The scan control signal generator 222 may generate a control signal CS based on the first image signal IMAGE1. The scan control signal generator 222 may provide the control signal CS to the level shifter 223 and timing controller 320 of the slave driver 300. The level shifter 223 may amplify the voltage level of the control signal CS and provide the amplified control signal CS to a scan driver of a first area as a scan control signal SCS.

The compensator 224 may generate a first compensation control signal SC1 that compensates the first image signal IMAGE1 based on the first image signal IMAGE1 from the frame memory 221 and a second image signal IMAGE2 from the slave driver 300. The compensator 224 may provide the first image signal IMAGE1 to the slave driver 300 or receive the second image signal IMAGE2 from the slave driver 300, for example, through a serial interface. The compensator 224 may prevent a difference between an image displayed on the first area and an image displayed on the second area by generating the first compensation control signal SC1 that compensates the first image signal IMAGE1 based on the first image signal IMAGE1 and the second image signal IMAGE2.

The synchronization signal generator 225 may generate synchronization signals SYNC that control an output timing of the first compensation signal SC1. For example, the synchronization signals SYNC may include a clock signal, a horizontal synchronization signal (Hsync), and a vertical synchronization signal (Vsync). The synchronization signals SYNC may be provided to the data processor 226 and the slave driver 300.

The data processor 226 may compensate the first image signal IMAGE1 to generate a first compensation signal IMGAE1_C based on the first compensation control signal SC1 and may output the first compensation signal IMAGE1_C to the data driver 240 based on the synchronization signals SYNC from the synchronization signal generator 225.

The data driver 240 may convert the first compensation signal IMAGE1_C to an analog voltage corresponding to a grayscale value. The analog voltage may be provided to pixels in the first area as a first data signal DATA1.

The slave driver 300 may include a timing controller 320 and a data driver 340. The timing controller 320 may include a frame memory 321, a scan control signal generator 322, a level shifter 323, a compensator 324, a synchronization generator 325, and a data processor 326. The frame memory 321 may store the second image signal IMAGE2 provided to the slave driver 300 per frame. The scan control signal generator 322 may not be operated. For example, the scan control signal generator 322 may not generate a control signal. The control signal CS generated in the master driver 200 may be provided to the level shifter 323 of the slave driver 300. The level shifter 323 may amplify a voltage level of the control signal CS and may provide the amplified control signal CS to a scan driver of the second area as a scan control signal SCS.

The compensator 324 may generate a second compensation control signal SC2 that compensates the second image signal IMAGE2 based on the second image signal IMAGE2 from the frame memory 321 and the first image signal IMAGE1 from the master driver 200. The compensator 324 may provide the second image signal IMAGE2 to the master driver 200 or may receive the first image signal IMAGE1 from the master driver 200, for example, through the serial interface.

The compensator 324 may prevent the difference between the image displayed on the first area and the image displayed on the second area by generating the second compensation control signal SC2 that compensates the second image signal IMAGE2 based on the first image signal IMAGE1 and the second image signal IMAGE2. The synchronization signal generator 325 may not be operated. For example, the synchronization signal generator 325 may not generate synchronization signals. The synchronization signals SYNC generated in the master driver 200 may be provided to the data processor 326 of the slave driver 300.

The data processor 326 may compensate the second image signal IMAGE2 in a second compensation signal IMAGE2_C based on the second compensation control signal SC2 and output the second compensation signal IMAGE2_C to the data driver 340 based on the synchronization signals SYNC from the master driver 200.

The data driver 340 may convert the second compensation signal IMAGE2_C to an analog voltage corresponding to a grayscale value. The analog voltage may be provided to pixels in the second area as a second data signal DATA2. As described above, the scan control signal generator 322 and the synchronization signal generator 325 may not be operated when the integrated circuit is operated as the slave driver 300 based on the select signal SEL_L having the low level. The slave driver 300 may receive the control signal CS and the synchronization signals SYNC from the master driver 200. Thus, the slave driver 300 may be synchronized with the master driver 200.

Figure 4A:
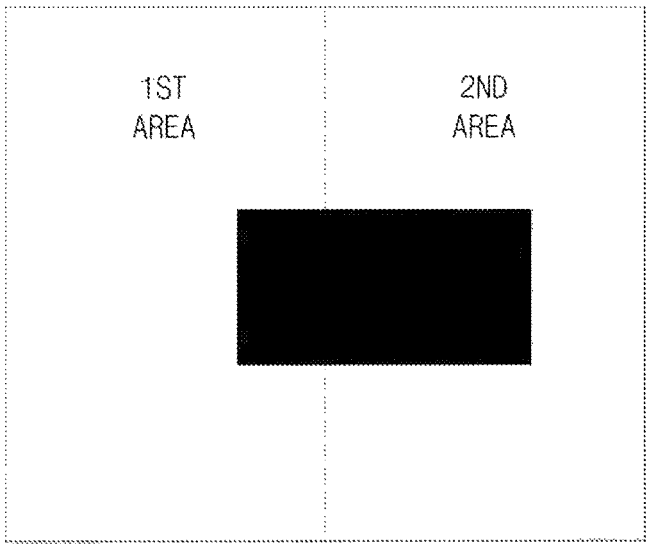
FIGS. 4A to 4C illustrate an operation of the display device.
Figure 4B:
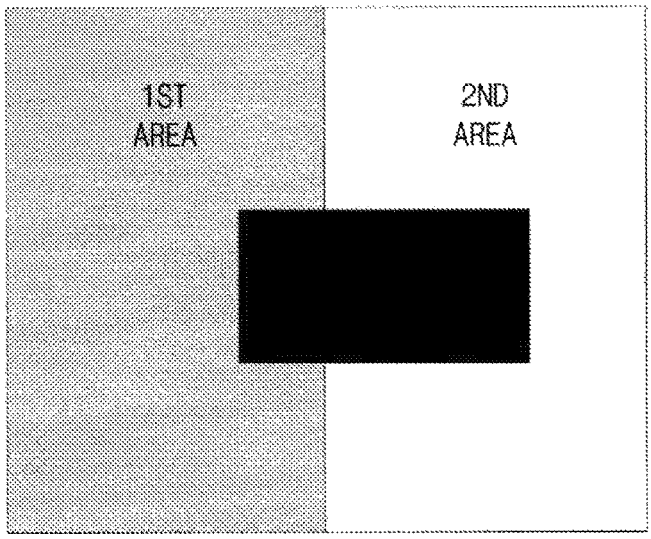
Figure 4C:
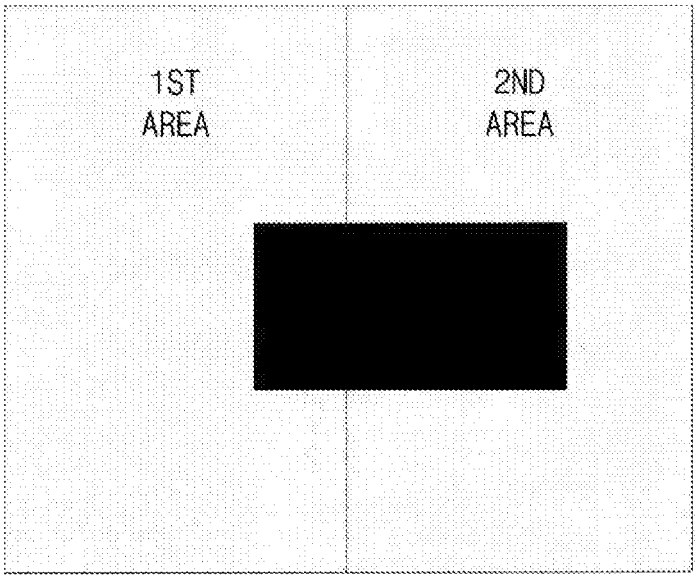

FIGS. 4A to 4C illustrates an example of an operation performed by the display device 100 of FIG. 1. A master driver and a slave driver may generate a first compensation control signal and a second compensation control signal based on a first image signal and a second image signal. For example, the first image signal and the second image signal may be provided to a first area corresponding to the master driver and a second area corresponding to the slave driver as described in FIG. 4A.

The master driver and the slave driver may compensate the first image signal and the second image signal, for example, based on an automatic current limit method (ACL). The automatic current limit method may save power consumption by reducing the brightness of the image signal when display of the image signal provided to the display panel consumes more current than a predetermined current. The image signal may be displayed on the display panel, as described in FIG. 4B, when the master driver generate a first compensation signal based on the first image signal and the slave driver generate a second compensation signal based on the second image signal.

A difference between the image displayed on the first area 1ST AREA and the image displayed on the second area 2ND AREA may occur. For example, the brightness of the first image signal may be reduced to a greater extent than the brightness of the second image signal because the brightness of the first image signal is greater than the brightness of the second image signal. Thus, the difference between the image displayed on the first area 1ST AREA and the image displayed on the second area 2ND AREA may occur as described in FIG. 4B.

The display device may prevent the difference between the image displayed on the first area 1ST AREA and the image displayed on the second area 2ND AREA by generating the first compensation control signal and the second compensation control signal based on both the first image signal and the second image signal in each of the master driver and the slave driver.

The master driver and the slave driver may provide and receive the first image signal and the second image signal, for example, through a serial interface. In one embodiment, the brightness of the first image signal and the brightness of the second image signal may be reduced by the same amount, because the master driver and the slave driver may adjust the automatic current limit method based on a total brightness of the first image signal and the second image signal. Thus, the difference between the image displayed on the first area 1ST AREA and the image displayed on the second area 2ND AREA may be reduced or prevented as described in FIG. 4C.

Figure 5:
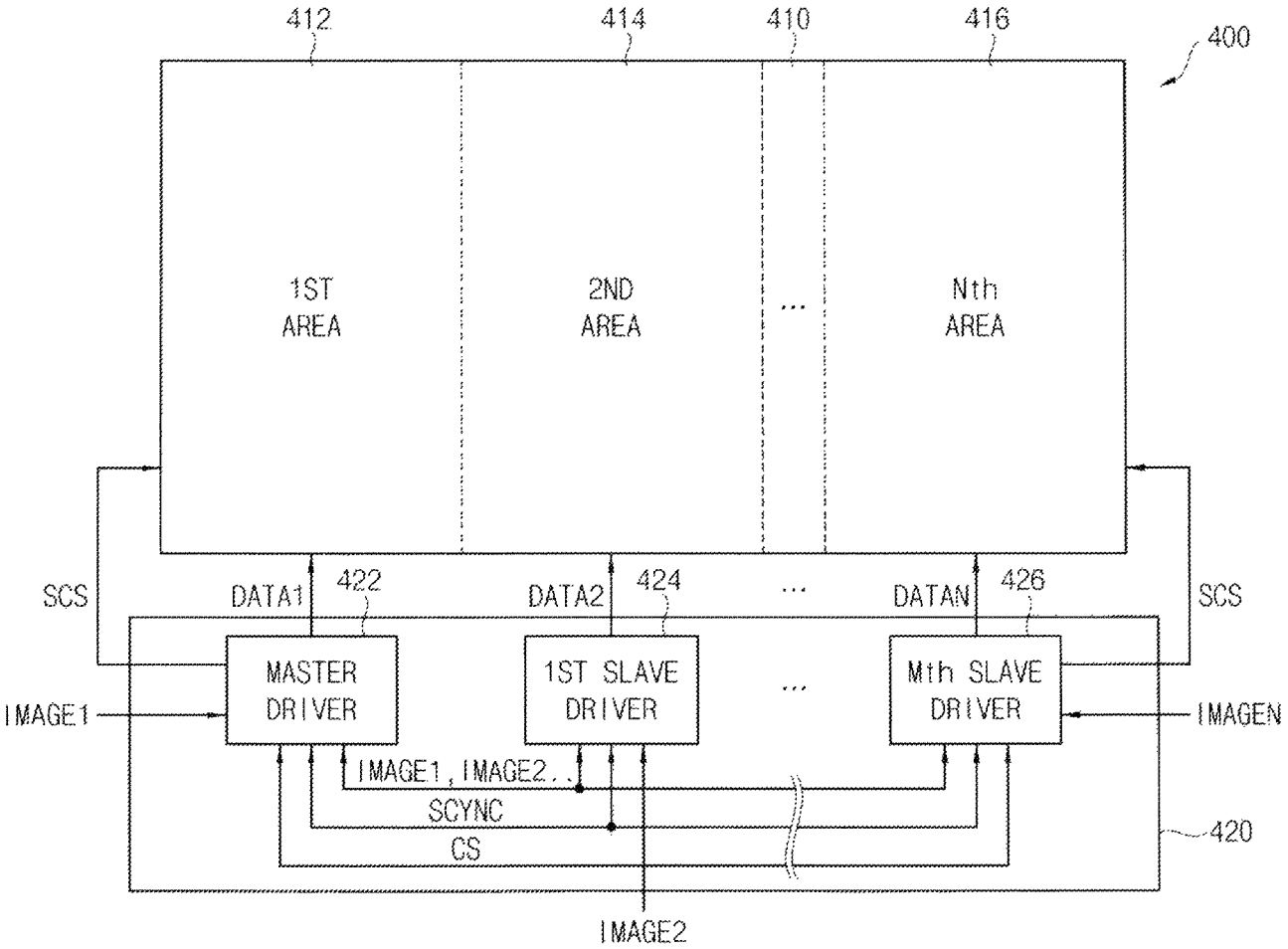
FIG. 5 illustrates another embodiment relating to the display device.

FIG. 5 illustrates another embodiment of a display device 400 which includes a display panel 410 and a driver 420. The display panel 410 may include a plurality of pixels and may be divided into N regions 412, 414, 416 corresponding to the numbers of a master driver 422 and slave drivers 424, 426. Scan drivers generate scan signals based on a scan control signal SCS and may be in a non-display area of a first (e.g., left) side of the display panel 410 and a non-display area of a second (e.g., right) side of the display panel 410.

The driver 420 may include the master driver 422 and M slave drivers 424, 426. The master driver 422 and the slave drivers 424, 426 may be implemented as a multi-chip that includes a timing controller and a data driver. The master driver 422 may generate a control signal CS that controls the scan driver of the display panel and may generate the scan control signal SCS by changing a voltage level of the control signal CS. The master driver 422 may provide the scan control signal SCS to the first area 412. Further, the master driver may provide the control signal to the Mth slave driver 426.

The master driver 422 may compensate a first image signal IMAGE1 to a first compensation signal based on the first through Nth image signals IMAGE1, IMAGE2, . . . , IMAGEN provided to the first area 412 through the Nth area 416. The master driver 422 and the slave drivers 424, 426 may provide and receive the first through Nth image signals IMAGE1, IMAGE2, . . . , IMAGEN, for example, through a serial interface.

The master driver 422 may generate synchronization signals SYNC that control an output timing of the first compensation signal. The timing controller of the master driver 422 may provide the synchronization signals SYNC to each of the first slave driver 424 through the Mth slave driver 426. The data driver of the master driver 422 may convert the first compensation signal from the timing controller of the master driver 422 to an analog voltage corresponding to a grayscale value. The analog voltage may be provided to pixels in the first area 412 as a first data signal DATA1.

The Mth slave driver 426 may generate the scan control signal SCS by changing a voltage level of the control signal CS from the master driver 422. The Mth slave driver 426 may provide the scan control signal SCS to the Nth area 416. The second slave driver 424 through the (M−1)th slave driver may not generate the scan control signal SCS. The first slave driver 424 through the Mth slave driver 426 may compensate the second through the Nth image signal IMAGE2, . . . , IMAGEN to the second through the Nth compensation signals based on the first through the Nth image signals IMAGE1, IMAGE2, . . . , IMAGEN provided to the first area 412 through the Nth area 416. For example, the second slave driver 424 may compensate the second image signal IMAGE2 to the second compensation signal based on the first through Nth image signals IMAGE1, IMAGE2, . . . , IMAGEN.

The Mth slave driver 426 may compensate the Nth image signal to the Nth compensation signal based on the first through Nth image signals IMAGE1, IMAGE2, . . . , IMAGEN. The master driver 422 and the slave drivers 424, 426 may provide and receive the first through Nth image signals IMAGE1, IMAGE2, . . . , IMAGEN, for example, through a serial interface. The first slave driver 424 through the Mth slave driver 426 may provide the second through Nth compensation signals to the data drivers of the first slave driver 424 through the Mth slave driver 426 based on the synchronization signals SYNC from the master driver 422. The data drivers of the first slave driver 424 through the Mth slave driver 426 may convert the compensation signals from the timing controller of the first slave driver 424 through the Mth slave driver 426 into an analog voltage corresponding to the grayscale value. The analog voltage may be provided to the second area 414 through the Nth area 416 as a second data signal DATA2 through the Nth data signal DATAN.

FIG. 5 illustrates another embodiment of a display device 500 which includes a master driving 524 and slave drivers 522 and 526. The master driver 524 may generate a control signal CS for input to first slave driver 522 and an Mth slave driver 526 when the master driver 524 is in a middle area of the display panel 510. The first slave driver 522 and the Mth slave driver 526 may generate a scan control signal SCS by changing a voltage level of the control signal SC from the master driver 524. The first slave driver 522 may provide the scan control signal SCS to the first area 512. The Mth slave driver 526 may provide the scan control signal SCS to the Nth area 516.

Figure 6:
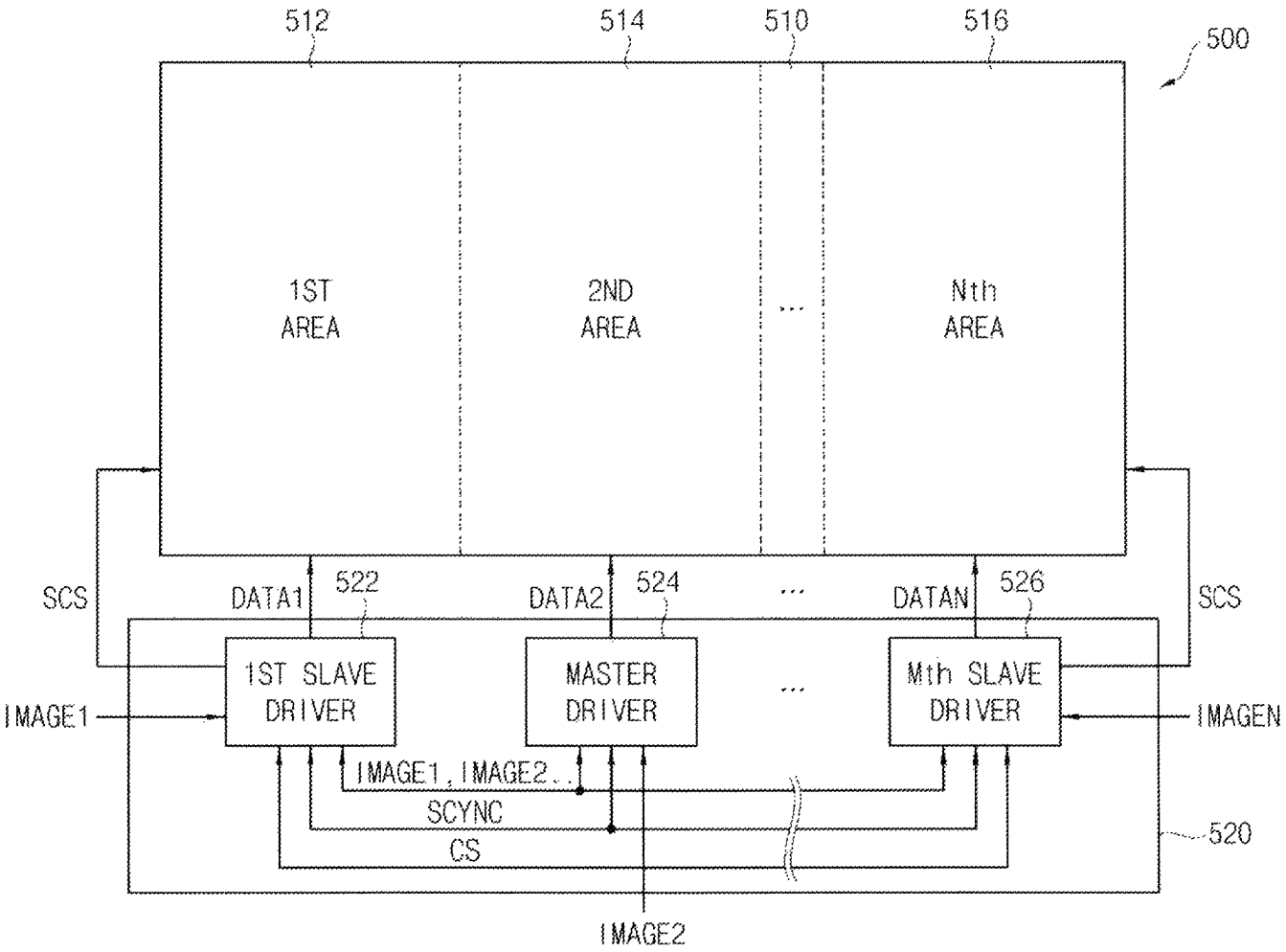
FIG. 6 illustrates another embodiment relating to the display device.

As described above, the display devices 400 and 500 in FIGS. 5 and 6 may synchronize the master driver and the slave drivers by providing the control signal CS and the synchronization signals SYNC generated in the master driver to the slave drivers. Further, the display device 400 may reduce or prevent the difference between the images displayed on the first through Nth area by generating each of the compensation signal based on the first through Nth image signals.

Figure 7:
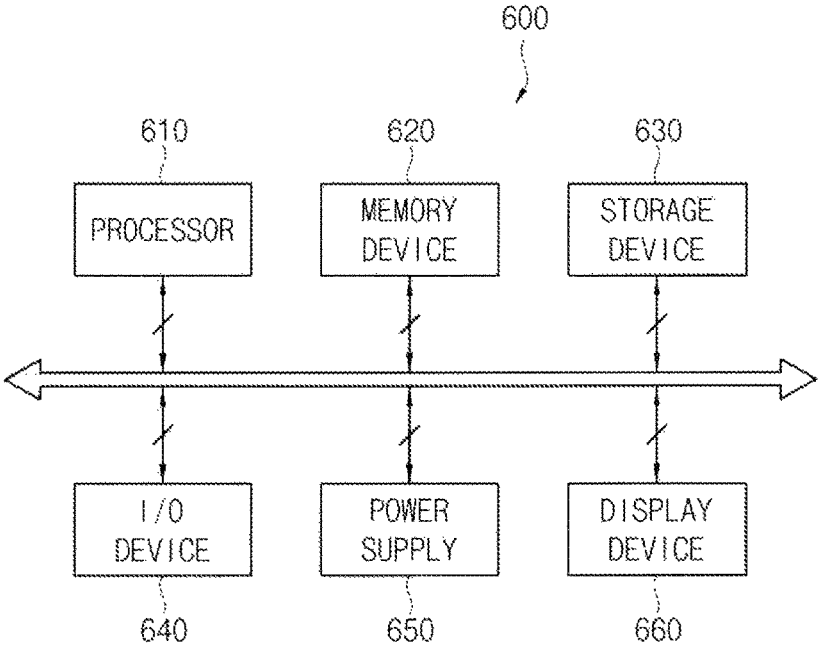
FIG. 7 illustrates an embodiment of an electronic device.
Figure 8:
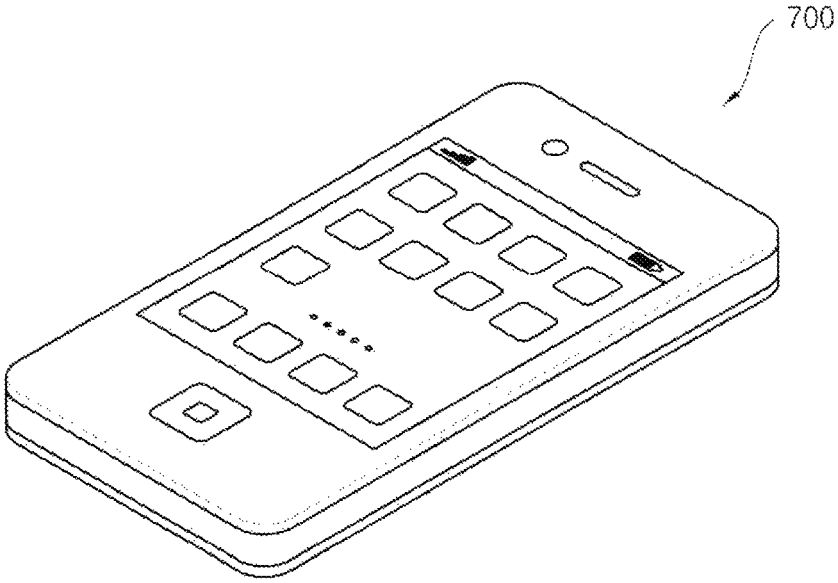
FIG. 8 illustrates an embodiment of a smart phone.

FIG. 7 illustrates an embodiment of an electronic device 600, and FIG. 8 illustrates an embodiment in which electronic device 600 of FIG. 7 is a smart phone 700.

Referring to FIGS. 7 and 8, the electronic device 600 may include a processor 610, a memory device 620, a storage device 630, an input/output (I/O) device 640, a power device 650, and a display device 660. The display device 660 may correspond to the display device 100 of FIG. 1. In addition, the electronic device 600 may include a plurality of ports for communicating a video card, a sound card, a memory card, a universal serial bus (USB) device, other electronic device, etc. In another embodiment, the electronic device 600 may be an electronic device different from a smart phone.

The processor 610 may perform various computing functions. The processor 610 may be a micro processor, a central processing unit (CPU), etc. The processor 610 may be coupled to other components via an address bus, a control bus, a data bus, etc. Further, the processor 610 may be coupled to an extended bus such as peripheral component interconnect (PCI) bus. The memory device 620 may store data for operations of the electronic device 200. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 630 may be a solid stage drive (SSD) device, a hard disk drive (HDD) device, a CD-ROM device, etc.

The I/O device 640 may be an input device such as a keyboard, a keypad, a touchpad, a touch-screen, a mouse, etc., and an output device such as a printer, a speaker, etc. In some example embodiments, the display device 660 may be in the I/O device 640. The power device 650 may provide a power for operations of the electronic device 200. The display device 660 may communicate with other components via the buses or other communication links. As described above, the display device 660 may include a display panel and a driver. The display panel may include a plurality of pixels. The display panel may be divided into a plurality of area corresponding to the number of a master driver and slave drivers. Scan drivers that generate a scan signal based on a scan control signal may be on respective sides of the display panel (in a non-display area).

The driver may include the master driver and the slave drivers. The master driver and the slave drivers may be implemented as a multi-chip that includes a timing controller and a data driver. The master driver may generate a control signal that controls the scan driver and may generate a scan control signal by changing a voltage level of the control signal. Further, the master driver may provide a control signal to the slave driver. The slave driver may generate the scan control signal by changing the voltage level of the control signal. The scan control signal generated in the master driver and the slave driver may be provided to the scan driver in the non-display area.

The master driver and the slave driver may generate compensation signals that compensate image signals provided to the master driver and the slave drivers based on the image signal provided to the each of the areas of the display panel. The master driver and the slave drivers may provide and receive the image signals, for example, through a serial interface. The master driver may generate synchronization signals and may provide the synchronization signals to the slave driver. The master driver and the slave drivers may provide compensate signals to each of data drivers based on the synchronization signals.

The data driver of the master driver and the data driver of the slave driver may convert the compensation signal to analog voltages corresponding to grayscale values and provide the analog signals to the plurality of areas of the display panel as a data signal.

As described above, an electronic device may include the display device that includes the master driver and the plurality of slave drivers synchronized to the master driver. The display device may synchronize the master driver and the slave drivers by providing the control signal and the synchronization signals generated in the master driver to the slave drivers. Further, the master driver and the slave driver may generate controls signals of each of the regions based on the image signal provided to all regions. Thus, differences between images displayed on each of the area may be reduced or prevented to thereby improve image quality of the display.

The embodiments described herein may be applied, for example, to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments as set forth in the claims.

What is claimed is:

1. A display device, comprising:

a display panel including a first area and a second area that include a plurality of pixels; and a driver including a master driver and a slave driver, the master driver to compensate a first image signal for the first area to generate a first compensation signal based on the first image signal and a second image signal for the second area, and to provide a first data signal corresponding to the first compensation signal and a scan control signal to the first area, the slave driver to compensate the second image signal to generate a second compensation signal based on the first image signal and the second image signal and to provide a second data signal corresponding to the second compensation signal and the scan control signal to the second area, wherein the master driver and the slave driver are implemented as integrated circuits, respectively, each integrated circuit including a timing controller and a data driver that are integrated together, wherein the timing controller of the master driver is to generate a control signal to control a scan driver of the display panel and to provide the control signal to the timing controller of the slave driver, and wherein the timing controller of the slave driver generates the scan control signal by changing a voltage level of the control signal provided from the timing controller of the master driver.

2. The display device as claimed in claim 1, wherein the timing controller of the master driver is to generate synchronization signals to control an output timing of the first compensation signal and the second compensation signal and is to provide the synchronization signals to the timing controller of the slave driver.

3. The display device as claimed in claim 2, wherein:

the master driver is to provide the first compensation signal to the data driver of the master driver based on the synchronization signals, and the slave driver is to provide the second compensation signal to the data driver of the slave driver based on the synchronization signals.

4. The display device as claimed in claim 1, wherein the timing controller of the master driver is to:

generate the scan control signal by changing a voltage level of the control signal.

5. The display device as claimed in claim 4, wherein the master driver is to provide the scan control signal to a scan driver of the first area.

6. The display device as claimed in claim 1, wherein the timing controller of the master driver is to generate a first compensation control signal to compensate the first image signal based on the first image signal and the second image signal and is to compensate the first image signal into the first compensation signal based on the first compensation control signal.

7. The display device as claimed in claim 1, wherein the timing controller of the slave driver is to generate a second compensation control signal to compensate the second image signal based on the first image signal and the second image signal and is to compensate the second image signal into the second compensation signal based on the second compensation control signal.

8. The display device as claimed in claim 1, wherein:

each of the master driver and the slave driver includes a select terminal, and the master driver and the slave driver are to be operated as the master driver and the slave driver based on a select signal provided to the select terminal.

9. The display device as claimed in claim 1, wherein the driver includes at least one slave driver.

10. An electronic device, comprising:

a display device; and a processor to control the display device, wherein the display device includes:

a display panel including a first area and a second area that include a plurality of pixels; and a driver including a master driver to compensate a first image signal corresponding to the first area to generate a first compensation signal based on the first image signal and a second image signal corresponding to the second area, to provide a first data signal corresponding to the first compensation signal and a scan control signal to the first area and a slave driver to compensate the second image signal to generate a second compensation signal based on the first image signal and the second image signal, and to provide a second data signal corresponding to the second compensation signal and the scan control signal to the second area, wherein the master driver and the slave driver are implemented as integrated circuits, respectively, each integrated circuit including a timing controller and a data driver that are integrated together, wherein the timing controller of the master driver is to generate a control signal to control a scan driver of the display panel and to provide the control signal to the timing controller of the slave driver, and wherein the timing controller of the slave driver generates the scan control signal by changing a voltage level of the control signal provided from the timing controller of the master driver.

11. The electronic device as claimed in claim 10, wherein the timing controller of the master driver is to generate synchronization signals to control an output timing of the first compensation signal and the second compensation signal and is to provide the synchronization signals to the timing controller of the slave driver.

12. The electronic device as claimed in claim 11, wherein:

the master driver is to provide the first compensation signal to the data driver of the master driver based on the synchronization signals, and the slave driver is to provide the second compensation signal to the data driver of the slave driver based on the synchronization signals.

13. The electronic device as claimed in claim 10, wherein the timing controller of the master driver is to:

generate the scan control signal by changing a voltage level of the control signal.

14. The electronic device as claimed in claim 13, wherein the master driver is to provide the scan control signal to a scan driver of the first area.

15. The electronic device as claimed in claim 10, wherein the timing controller of the master driver is to generate a first compensation control signal to compensate the first image signal based on the first image signal and the second image signal and is to compensate the first image signal into the first compensation signal based on the first compensation control signal.

16. The electronic device as claimed in claim 10, wherein the timing controller of the slave driver is to generate a second compensation control signal to compensate the second image signal based on the first image signal and the second image signal and to compensate the second image signal based on the second compensation control signal.

17. The electronic device as claimed in claim 10, wherein:

each of the master driver and the slave driver includes a select terminal, and the master driver and the slave driver are to be operated as the master driver and the slave driver based on a select signal provided to the select terminal.

18. The electronic device as claimed in claim 10, wherein the driver includes at least one slave driver.

* * * * *